United States Patent [19]

Bottum

[11] 4,383,419

[45] May 17, 1983

[54] HEATING SYSTEM AND METHOD

[76] Inventor: Edward W. Bottum, 9357 Spencer Rd., Brighton, Mich. 48116

[21] Appl. No.: 795,812

[22] Filed: May 11, 1977

[51] Int. Cl.[3] ..... F25B 27/02

[52] U.S. Cl. ..... 62/238.6; 62/235.1; 62/260; 62/119

[58] Field of Search ..... 62/238, 260, 2, 324, 62/119; 165/45

[56] References Cited

U.S. PATENT DOCUMENTS

| | | | |
|---|---|---|---|
| 2,289,809 | 7/1942 | Sherwood | 62/119 |
| 2,513,373 | 7/1950 | Sporn et al. | 165/45 |
| 2,581,744 | 1/1952 | Zimmerman | 165/45 |
| 2,715,320 | 8/1955 | Wright | 62/238 |
| 2,726,067 | 12/1955 | Wetherbee et al. | 165/45 |
| 3,035,419 | 5/1962 | Wigert | 62/119 |
| 3,112,890 | 12/1963 | Snelling | 62/119 |
| 3,782,132 | 1/1974 | Lohoff | 165/45 |
| 3,965,694 | 6/1976 | Vignal et al. | 62/260 |
| 4,042,012 | 8/1977 | Perry | 62/238 |

*Primary Examiner*—Lloyd L. King

*Attorney, Agent, or Firm*—Barnes, Kisselle, Raisch, Choate, Whittemore & Hulbert

[57] ABSTRACT

A heating system employing a heat pump, which is provided with a source of heat created by a second system employing refrigerant as a heat transfer medium, is provided. In the second system the refrigerant passes through a structure wherein the refrigerant is boiled. The refrigerant is then passed by vapor pressure to a heat exchange structure where it gives off heat. The heat energy for boiling such refrigerant may be a readily available source of heat such as the ground, or a water storage system such as a pond, lake, swimming pool, river, well, or creek.

6 Claims, 3 Drawing Figures

HEATING SYSTEM AND METHOD

BACKGROUND OF THE INVENTION

The use of heat pumps augmented by a secondary system for collecting and supplying heat thereto for the purpose of heating structures such as buildings has been known in the past. However, the usage of heat pumps has been on a limited basis and primarily in only certain geographical areas where either the average temperature is quite high as, for example, in the south, or in areas where sun energy is plentiful and solar energy systems may be conveniently employed. However, in temperate and colder climates, it has not been as practical to use such techniques. Heat pumps perform very efficiently at outside ambient temperatures of 35°, 25°, or even 15° F. However, the efficiency of heat pumps drops off after temperatures become lower and at 10° to 15° F. evaporator temperature a heat pump is not very efficient.

The present invention provides structure for collecting heat energy from sources such as the ground, sunshine, ponds, lakes, swimming pools, rivers, wells, and creeks. Heat may also be transferred from such heat reservoirs as masonry or other storage mediums, including off peak storage banks.

The present system for collecting heat for the heat pump departs from past practice in that a refrigerant, such as the fluorinated hydrocarbons, is used as a heat transfer medium. In the system, a heat collector structure is filled with liquid refrigerant, the balance of the system containing refrigerant gas according to the pressure-temperature relationship of the refrigerant. Normally, there are no pressure reducing valves or regulating valves used in the system. The entire system being basically under the same pressure, such control devices may be dispensed with. However, this is not to exclude the use of such structures under certain conditions. The pressure will be determined by the condensing temperature in the heat dissipator.

In the present invention, latent heat of the refrigerant is picked up, causing the liquid refrigerant to "boil" and change to vapor according to the amount of heat picked up. Vapor pressure immediately travels to the heat dissipating device where the refrigerant condenses and returns as a liquid to the heat collecting structure, this being a continuous procedure as long as heat is being absorbed by the heat collecting structure.

Whenever the heat dissipator is located above the heat collecting structure, a circulating pump can usually be eliminated. When desired to locate the heat dissipator below or near the same height as heat pick up, a small refrigerant circulating pump is used. However, since latent heat of the refrigerant is used for heat movement, a relatively small weight of refrigerant needs to be circulated and very little power is required.

The refrigerant charged system is very useful in picking up an abundance of "low grade" heat for use by the heat pump. It is very important to the present invention that considerable amounts of low grade heat may be transferred from the ground, water or other heat storage means for use in heat pumps with the expenditure of very little or no energy.

The use of a refrigerant charged heat collecting system has many advantages as opposed to a heat collecting system employing a liquid which changes temperature upon absorption of heat as opposed to changing from a liquid to a gas. Some of the advantages are listed below:

(1) All concern as to freezing of heat collecting fluid at low temperature is forever eliminated, because the refrigerant does not freeze.

(2) Any question as to chemical action or corrosion in the system is completely eliminated.

(3) Toxicity is not a problem . Most common refrigerants are non-toxic and are used widely with foods.

(4) The refrigerant charged system is more efficient since basically latent heat is used instead of sensible heat as in the case of a liquid which does not become a gas. This also permits more heat to be moved through smaller lines and longer distances without a pump.

(5) In many cases the primary or circulating pump can be eliminated and a very efficient "passive" system can result.

(6) A refrigerant charged system can pick up a large amount of low grade energy for use with heat pumps.

(7) Refrigerants are most readily available. Since the system is never "flooded" only a few pounds of refrigerants are used and cost is low.

(8) Connections can readily be made with copper tubing and flare nuts. Also, copper tubing may be used and all joints "hard soldered". Pipe should not be used. Steel tubing may be used if joints are "hard soldered".

(9) Since the system is not "flooded" and latent heat is involved, check valves are not usually necessary to prevent reverse circulation.

(10) In the refrigerant charged system very small leaks can readily be found with a "Halide" leak detector.

(11) A network of refrigeration service engineers throughout the country already has the basic technology and tools to install and service refrigerant charged systems.

IN THE DRAWING

Figure 1:
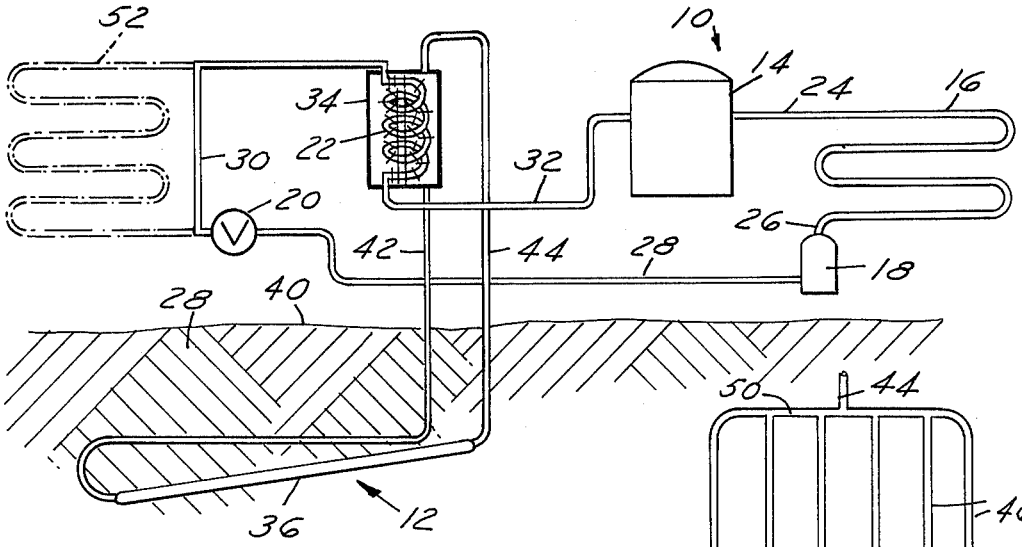
FIG. 1 is a diagrammatic view in accordance with one embodiment of the present invention.
Figure 2:
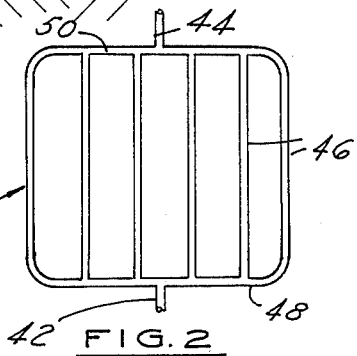
FIG. 2 is a plan view of the heat collecting structure utilized in the FIG. 1 embodiment.

Referring to the structure illustrated in FIGS. 1 and 2, a heat pump system 10 is used in conjunction with a heat collecting system 12.

The heat pump system 10 comprises a compressor 14, condenser 16, receiver 18, expansion valve 20, and evaporator 22. These structures are operatively connected together by means of conduits 24, 26, 28, 30, 32.

A heat pump, as is well known, is essentially a refrigeration system in reverse. In a refrigeration system, the condenser is normally located outside of the space to be cooled to thereby dissipate the heat generated in the condenser to the ambient atmosphere. The evaporator is located in a position enabling the cooling effect thereof to be transmitted to the space to be cooled. In the heat pump system 10, the evaporator 22 is located within vessel 34 and absorbs heat from refrigerant gas which flows therethrough and is condensed therein. This heat allows refrigerant in the evaporator 22 to expand into gaseous form. Gaseous refrigerant is drawn via conduit 32 to compressor 14 wherein it is compressed. The hot gases pass to condenser 16 via conduit 24. The compressed gases are condensed into liquid form in condenser 16, thus giving off heat. This heat is used by any desirable means to heat a building structure such as a house. The condensed liquid refrigerant passes from condenser 16 via conduit 26 into receiver 18. This liquid is transferred via conduit 28 through expansion valve 20 and thence back to evaporator 22 via conduit 30.

The heat collecting system 12 comprises the vessel 34 which serves as a refrigerant condenser and a heat collecting structure 36 which is buried in the ground 28, as for example, from 3 to 6 feet below ground level 40. The vessel 34 and heat collecting structure 36 are connected together by means of conduits 42, 44.

As will be noted in FIG. 2, the heat collecting structure 36 comprises a plurality of spaced apart parallel tubes 46 which are connected together at their lower ends by manifold tube 48 and at their upper ends by manifold tube 50. Conduits 42, 44 are connected to the manifold tubes. The unit may be, for example, from 20 to 30 feet square, with the tubes 46 being from 2 to 4 feet apart. The unit is buried in the ground at an angle with manifold 48 being slightly below manifold 50 so that liquid refrigerant will tend to collect in the lower portion thereof and gaseous refrigerant is free to move upwardly as a result of its own vapor pressure through conduit 44 to vessel 34. It is desirable to maintain the tubes 46 in essentially the flooded condition. This unit may be buried in the ground by means of a vertical drill or water flush method.

Standard refrigerant fluid suitable for use in refrigeration, normally fluorinated hydrocarbons, is used as the heat exchange medium in the heat collecting system 12 as well as in the heat pump system 10. The refrigerant changes from a liquid to a gas in the heat collecting structure 36 as a consequence of the heat present in the ground. The heat in the ground has as its source heat generated centrally of the earth and also solar energy which may heat the earth during periods of warmth.

In operation of the system, liquid refrigerent is boiled in the heat collecting structure 36. The gaseous refrigerant passes to the vessel 34 as a consequence of its own vapor pressure. It is not pumped by external means. The gaseous refrigerant condenses in vessel 34, thus giving off heat. The liquid refrigerant then returns to the heat collecting structure 36 by means of gravity, it being noted that structure 36 is located below vessel 34. The heat given off in vessel 34 is utilized by the heat pump system 10 as previously described.

The system may be further modified by the provision of an outside air coil 52. This coil is connected across coil 22 and valve 20 with conduit 30 removed. When the outside air temperature is relatively high, liquid refrigerant passed through expansion valve 20 will evaporate in coil 52 and pass back to the compressor 14 via evaporator coil 22. When the air temperature falls, liquid refrigerant will pass through coil 52 without evaporating but will be automatically evaporated in evaporator coil 22. The system as thus described takes advantage of both heat energy in the air and heat energy present in the ground.

It should be noted that refrigerant passing through the system 12 does not require the expenditure of power. However, should the heat collector structure 36 be located at the level or above vessel 34, a small refrigerant circulating pump may be used. The power requirements for such a pump would be extremely low, since it is only a circulating pump and must move only relatively small volumes of refrigerant.

Figure 3:
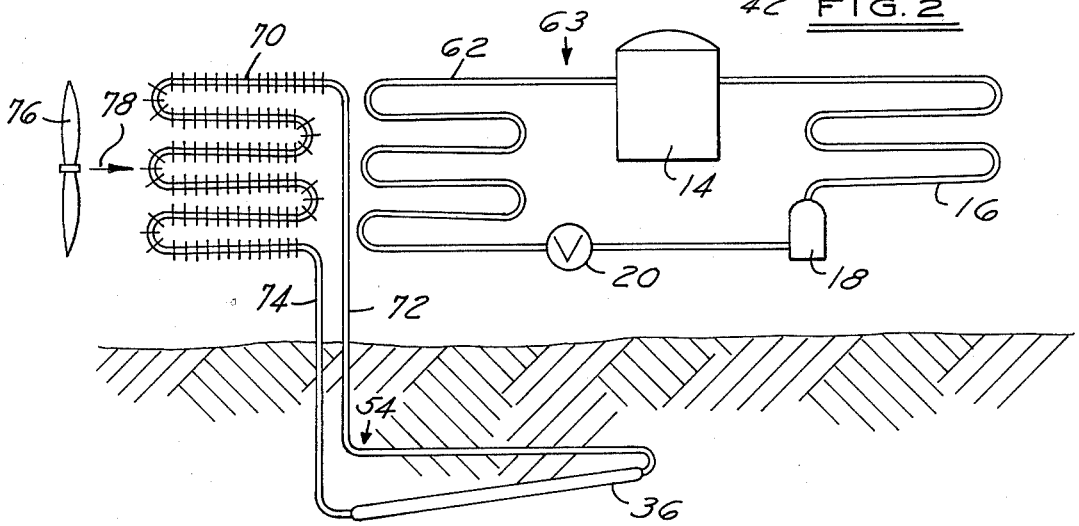
FIG. 3 is a diagrammatic view of another embodiment of the present invention.

FIG. 3 illustrates a modified version of the system. In FIG. 3, the heat pump system 63 comprises the compressor 14, condenser 16, receiver 18, and evaporator 62, all connected together in operative relationship.

The heat collecting system 54 again includes the heat collecting structure 36 buried in the ground as previously described. The outlet is connected to the inlet of a finned coil 70 by means of conduit 72. The outlet of coil 70 is connected to the inlet of structure 36 by means of conduit 74. The coil 70 is placed in heat exchange relationship with evaporator coil 62 of the heat pump system 63. A fan or blower 76 is provided adjacent the coil 70 to blow air thereover in the direction of arrow 78. This warm air passes over the evaporator coil 62 to thereby heat refrigerant passing therethrough. Both of the systems 54, 63 otherwise operate as previously described.

What I claim as my invention is:

1. A heating system comprising a heat pump system and a heat collecting system, said heat pump system including a compressor, evaporator, and condenser, all connected together in operative relationship, said heat collecting system comprising a source of heat energy, a heat collector structure positioned to collect heat from said source, said heat collecting structure comprising a plurality of spaced apart tubular members, an inlet manifold connected to one end of said tubular members and an outlet manifold connected to the other end of said tubular members, said heat collecting structure being positioned with said inlet manifold below said outlet manifold, heat dissipating structure and means for circulating a refrigerant heat transfer medium in gaseous form from the heat collector structure to the heat dissipating structure and in liquid form from the heat dissipating structure to the heat collecting structure, all connected together in operative relationship, and a refrigerant heat transfer medium in said heat collecting system, said heat dissipating structure being located above said heat collecting structure, said liquid refrigerant flowing from said heat dissipating structure to the heat collecting structure by gravity and gaseous refrigerant flowing from the heat collecting structure to said heat dissipating structure as a consequence of its own vapor pressure, said evaporator of the heat pump system being in heat exchange relationship with said heat dissipating structure of the heat collecting system.

2. A heating system comprising a heat pump system and a heat collecting system, said heat pump system including a compressor, evaporator, and condenser, all connected together in operative relationship, said heat collecting system comprising a source of heat energy, a heat collector structure positioned to collect heat from said source, heat dissipating structure and means for circulating a refrigerant heat transfer medium in gaseous form from the heat collector structure to the heat dissipating structure and in liquid form from the heat dissipating structure to the heat collecting structure, all connected together in operative relationship, and a refrigerant heat transfer medium in said heat collecting system, said heat dissipating structure being located above said heat collecting structure, said liquid refrigerant flowing from said heat dissipating structure to the heat collecting structure by gravity and gaseous refrigerant flowing from the heat collecting structure to said heat dissipating structure as a consequence of its own vapor pressure, said evaporator of the heat pump system being in heat exchange relationship with said heat dissipating structure of the heat collecting system, said heat pump system having a second evaporator positioned in the ambient atmosphere to evaporate refrigerant before it passes through the previously mentioned heat pump system evaporator on warm days.

3. A heating system comprising a heat pump system and a heat collecting system, said heat pump system including a compressor for compressing a heated gas refrigerant passed thereto at a relatively low pressure from an evaporator to provide an output of heated gas refrigerant at a relatively high pressure, a condenser connected to the compressor to receive the heated gas refrigerant at high pressure operable to dissipate heat from the gas and to provide a liquid refrigerant at the output of the condenser, a receiver connected to the output of the condenser to receive the liquid refrigerant therefrom and to provide a reservoir of liquid refrigerant, an expansion valve connected to the receiver for receiving liquid refrigerant from the receiver and operable to pass the liquid refrigerant therefrom in a low temperature gaseous form, an evaporator connected to the expansion valve to receive the low temperature gaseous refrigerant and heat transfer means operably associated with the evaporator for heating the low pressure gaseous refrigerant for passage to the compressor, said heat collecting system comprising heat collecting structure including a plurality of spaced apart substantially parallel tubular members, an inlet manifold connected to one end of each of said parallel tubular members and an outlet manifold connected to the other end of each of said tubular members, said heat collecting structure being positioned below the surface of the earth whereby the earth functions as a source of heat energy, said heat collecting structure being positioned with said inlet manifold below said outlet manifold, heat dissipating structure operably associated with the evaporator of the heat pump system and means directly connecting the inlet manifold of the heat collecting structure to the lower end of the heat dissipating structure and means for connecting the outlet manifold of the heat collecting structure to the upper end of the heat dissipating structure and a refrigerant heat transfer medium in said heat collecting system with said heat dissipating structure being located above said heat collecting structure, said liquid refrigerant flowing from said heat dissipating structure to the heat collecting structure by gravity and gaseous refrigerant flowing from the heat collecting structure to said heat dissipating structure as a consequence of its own vapor pressure.

4. Structure as set forth in claim 3, wherein the evaporator of the heat pump system comprises a coiled tube and the heat dissipating structure of the heat collecting system comprises a vessel containing the evaporator coil through which refrigerant from the heat collecting system circulates.

5. Structure as set forth in claim 3, wherein the evaporator of the heat pump system further includes evaporator coils outside of the vessel of the heat collecting system between the expansion valve and evaporator coils within the vessel of the heat dissipating structure.

6. Structure as set forth in claim 3, wherein the evaporator of the heat pump system comprises evaporator coils positioned between the expansion valve and compressor and the heat dissipating structure of the heat collecting system comprises heating coils positioned adjacent the evaporator coils, and blower means for flowing air over the heating coils of the heat collecting system and then over the evaporator coils of the heat pump system.

* * * * *